US008530378B2

(12) United States Patent
Croskey

(10) Patent No.: US 8,530,378 B2
(45) Date of Patent: Sep. 10, 2013

(54) APPARATUS AND METHOD FOR DESTROYING CONFIDENTIAL MEDICAL INFORMATION ON LABELS FOR MEDICINES

(75) Inventor: Timothy Croskey, Florissant, MO (US)

(73) Assignee: The Power Fountain, LLC, Black Jack, MO (US)

( * ) Notice: Subject to any disclaimer, the term of this patent is extended or adjusted under 35 U.S.C. 154(b) by 154 days.

(21) Appl. No.: 13/314,431

(22) Filed: Dec. 8, 2011

(65) Prior Publication Data

US 2012/0165188 A1 Jun. 28, 2012

Related U.S. Application Data

(60) Provisional application No. 61/427,646, filed on Dec. 28, 2010.

(51) Int. Cl.
*B41M 5/30* (2006.01)

(52) U.S. Cl.
USPC ..... 503/201

(58) Field of Classification Search
None
See application file for complete search history.

(56) References Cited

U.S. PATENT DOCUMENTS 7,262,150 B2 * 8/2007 Kalishek et al. ..... 503/201

* cited by examiner

*Primary Examiner* — Bruce H Hess
(74) *Attorney, Agent, or Firm* — Polster Lieder Woodruff & Lucchesi, LC

(57) ABSTRACT

The present disclosure provides a microwaveable information destruction apparatus for rendering unreadable indicia printed on a label. In various embodiments the apparatus comprises an attachable information destruction strip structured and operable to be adhered to a substrate having disposed thereon a thermally responsive label with indicia printed thereon and/or the thermally responsive label. The information destruction is attachable such that the information destruction strip is in a thermally conductive relationship with the thermally responsive label. The information destruction strip is sized to cover at least the indicia printed on the thermally responsive label. Additionally, the information destruction strip comprises a microwave activated material operable to generate heat when exposed to microwave energy. The generated heat is of sufficient intensity to heat the thermally responsive label to a temperature sufficient to cause the thermally responsive label to react and render the indicia unreadable.

5 Claims, 8 Drawing Sheets

APPARATUS AND METHOD FOR DESTROYING CONFIDENTIAL MEDICAL INFORMATION ON LABELS FOR MEDICINES

CROSS-REFERENCE TO RELATED APPLICATIONS

This application claims the benefit of U.S. Provisional Application No. 61/427,646, filed on Dec. 28, 2010. The disclosure(s) of the above application(s) is (are) incorporated herein by reference in its entirety.

BACKGROUND OF THE DISCLOSURE

The present disclosure relates to an apparatus for destroying printed information; and, in particular, relates to a portable apparatus that thermally destroys confidential medical information using microwave or other high energy absorption.

Typically, when a patient visits a physician, the physician writes a prescription or order for the patient. When the pharmacist renews the prescription, the pharmacist locates the pharmaceutical from the pharmacy's inventory that corresponds to the prescription and prepares the pharmaceutical for dispensing to the patient. Often, the pharmaceutical requires a container, such as a pill bottle or other container. Other pharmaceuticals are dispensed in prepackaged or preassembled containers or boxes and the like for dispensing. For those liquid pharmaceuticals that require containers of any nature, the pharmacist dispenses the liquid pharmaceutical to the patient in the appropriate container.

As a part of the dispensing process, the pharmacist prints a label that has relevant confidential information about the written prescription including the patient's name, physician's name, pharmaceutical's name, dosage, and instructions for taking the pharmaceutical. Other information, such as general information about the pharmaceutical and/or the patient, can also be printed on the label for the patient. Once the pharmacist has completed preparing the container, the label is attached to the specifically filled container or to the preassembled package, and provided to the patient.

Documents, such as these prescription labels, financial records and other items, often contain sensitive or confidential information. With passage of ever more stringent privacy obligations, such as patient's rights bills, the Health Insurance Portability and Accountability Act (HIPPA) requirements in the U.S., there is a need to control private information to maintain confidentiality, reduce liability exposure, and prevent careless or inadvertent disclosure of private information. In the case of the prescription label on the medicine container, such as a medicament container or preassembled package, it is typically required that a hospital or care facility safeguard medical information when discarding medicine containers.

With increasing concerns relating to information security, prevention of identity theft, and protection of personal privacy, a variety of techniques have been adopted to preserve the confidentiality of printed information. A known method of safeguarding such medical information involves burning the container and/or the label. Burning the container or label, however, has adverse effects such as pollution and equipment operating and maintenance costs. Another safeguard method involves removing the prescription label from the container and then shredding the label. Such a shredding method generally complies with safeguarding requirements, but is burdensome in terms of time and effort. Additionally, portions of the label tend to stick to the container and thereby can expose the unshredded confidential information.

As to patient's home destruction of private information included on pill bottle and the like, prior techniques, such as shredding of the container or the label, have several drawbacks. First, most patients do not have a suitable shredder capable of shredding a container along with the label affixed thereto. However, even if a patient had such a shredder, the shredder would make noise, would be susceptible to jamming, and it can be possible for a determined party to reassemble the shredded information. In the event that the patient attempts to remove the label from the container, portions of the label can tend to adhere to the container leading to frustrated and repeated attempts by the patient to remove the label. Safeguard techniques relying on burning, convection heating, or heating elements are undesirable in home environments due to safety concerns associated with hot surfaces, fumes, and cleanliness issues in having to deal with ash or other debris.

SUMMARY

The present disclosure provides a microwaveable information destruction apparatus for rendering unreadable indicia printed on a label. In various embodiments the apparatus comprises an attachable information destruction strip structured and operable to be adhered to a substrate having disposed thereon a thermally responsive label with indicia printed thereon and/or the thermally responsive label. The information destruction is attachable such that the information destruction strip is in a thermally conductive relationship with the thermally responsive label. The information destruction strip is sized to cover at least the indicia printed on the thermally responsive label. Additionally, the information destruction strip comprises a microwave activated material operable to generate heat when exposed to microwave energy. The generated heat is of sufficient intensity to heat the thermally responsive label to a temperature sufficient to cause the thermally responsive label to react and render the indicia unreadable.

Other features of the present disclosure will be in part apparent and in part pointed out hereinafter.

BRIEF DESCRIPTION OF THE DRAWINGS

In the accompanying drawings which form part of the specification.

Corresponding reference numerals indicate corresponding parts throughout the several figures of the drawings.

DESCRIPTION

Figure 1:
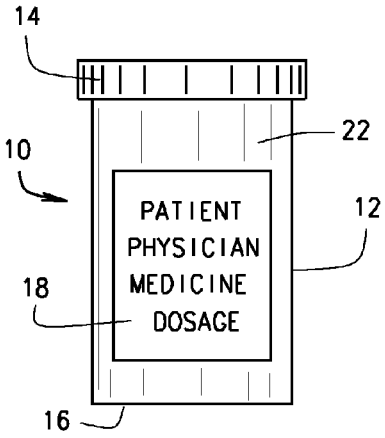
FIG. 1 is a front view of a prescription container having a thermally responsive label affixed thereto, the label having confidential information or indicia printed thereon, in accordance with various embodiments of the present disclosure.

The following description is merely exemplary in nature and is in no way intended to limit the present teachings, application, or uses. Throughout this specification, like reference numerals will be used to refer to like elements.

The present disclosure relates to an information destruction apparatus for destroying confidential information. For purposes of illustrations only, the apparatus will be described as incorporated into destroying medical information printed on a thermally responsive label for a medicament container. Applicant's co-pending application having Ser. No. 12/425,931 is incorporated by reference herein.

Figure 2:
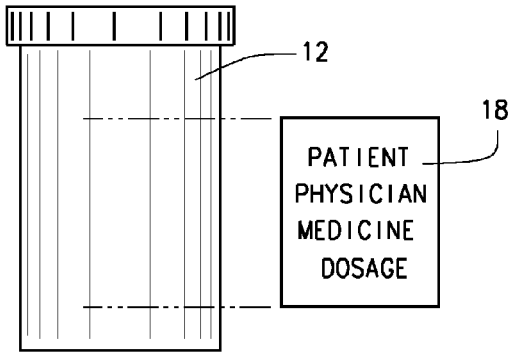
FIG. 2 illustrates the label of FIG. 1 removed from the container, in accordance with various embodiments of the present disclosure.

Referring to FIGS. 1 and 2, a medicament or pill container 10 used to dispense pharmaceuticals in known manners and in accordance with the principles of the present disclosure is shown in FIG. 1. The medicament container 10 includes a medicine retention bottle or vessel 12 and a cap 14 for closing the bottle. The bottle or vessel 12 is shown to be generally cylindrical having a closed end 16 and an open end (not shown) that receives cap 14 for closing the bottle. The cap 14 can be affixed to the open end of the bottle in any known manner, such as by threading the cap onto the open end of the vessel 12; or any of the known types of child-safety cap configurations; or the cap can be snapped in place on the open end of the container. As noted, bottle 12 is shown to be cylindrical, but containers of any shape can be used in conjunction with the present disclosure.

When a pharmacist prepares the medicament container 10 to dispense a pharmaceutical, the pharmacist follows the instructions found on a prescription or order prepared by a physician. As is well known, the pharmacist selects the prescribed pharmaceutical from an inventory and places the correct number of pills in the bottle or vessel 12 or dispenses the correct amount of pharmaceutical liquid into a suitable vessel 12 and closes the vessel 12 with the cap 14. The pharmacist also prints out a prescription information and instruction label 18 that is placed on the bottle or vessel 12. Typically, the thermally responsive label 18 contains confidential information such as, but not limited to, the patient's name, the physician's name, the name of the pharmaceutical, the dosage and the instructions. Other confidential or personal information can also be included on the thermally responsive label 18. As seen in FIG. 1, the thermally responsive label 18 is typically rectangular and fits on an outer surface 22 of the bottle 12. Different types and shapes of the bottle 12 and of the labels 18 are known, such as cylindrical shaped containers and rectangular shaped labels. Additionally, different shaped bottles 12 can have a variety of sizes ranging from heights from about a half inch to about ten inches and an outside width or diameter from about a half inch to about six inches.

In various embodiments, the thermally responsive label 18 comprises a thermally-responsive record material. Thermally-responsive record materials are known in the art such as that disclosed in U.S. Publication No. U.S. 2005/0282704, which is incorporated in this disclosure in its entirety by reference. Such record materials comprise a substrate having provided thereon a heat sensitive, color-forming composition. The color-forming composition includes dye material and an electron accepting developer material. The term "colored" dye material need not make any color mark other than black. The dye material comprises chromogenic materials, such as phthalide, leucauramine and fluoran compounds. Such thermally-responsive record materials are susceptible to rapid destruction or disfiguration, i.e., change of color or discoloration, when exposed to energy absorption or heat above ambient temperature. In particular, the dye and developer material are contained in a coating on the substrate which, when heated to suitable temperature, melt or soften to permit the materials to react, thereby producing a colored mark.

Accordingly, the thermally-responsive record material of label 18 is susceptible to rapid destruction or disfiguration, i.e., change of color or discoloration, when exposed to energy absorption or heat. Thus, when exposed to energy absorption or heat the thermally-responsive material of label 18 reacts to destroy, obliterate, alter or otherwise render unreadable indicia on the thermally responsive label 18.

Turning to FIGS. 3-6, as described above, the present disclosure provides an information destruction apparatus 20 for destroying confidential information. Although the information destruction apparatus 20 can be utilized to render unreadable information on any thermally response record or label that is disposed on or adhered to any label support structure or substrate, for purposes of illustrations, simplicity and clarity, the information destruction apparatus 20 will be described and illustrated herein as being incorporated to destroy medical information printed on thermally responsive prescription information and instruction labels, e.g., thermally responsive prescription information and instruction label 18, of medicament containers, e.g., medicament container 10.

In various embodiments, the information destruction apparatus 20 is constructed to provide an envelope or sleeve or housing, sometimes referred to herein as envelope 20, having a base layer 24 and a microwave activated layer 26. It should be noted that the thicknesses of the layers 24 and 26 shown in the FIGS. 3-6 are not drawn to scale, but rather are exaggerated for clarity of illustration.

Figure 4:
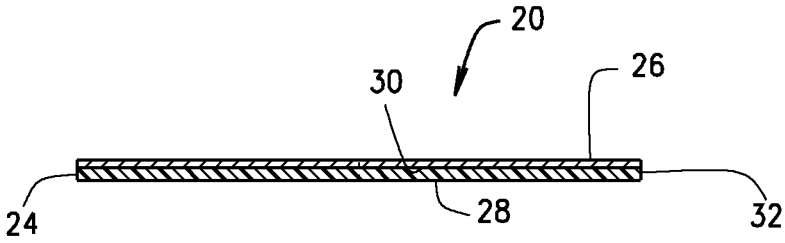
FIG. 4 illustrates an exaggerated edge view of the information destruction apparatus shown in FIG. 3, in accordance with various embodiments of the present disclosure.

The base layer 24 includes an outer surface 28, an inner surface 30 and a sidewall 32 that extends between the outer surface 28 and the inner surface 30 at the edges of the base layer 24 (shown in FIG. 4). In various implementations, the base layer 24 can comprise a substrate of a paperboard or corrugated paper and a polyethylene terephthalate (PET) material adhered or coupled to the paperboard. In one example, the paperboard couples to the PET material through the use of a pressure sensitive adhesive. Suitable pressure sensitive adhesives include solvent-coatable, hot-melt-coatable, radiation-curable and water-based emulsion type adhesives that are known in the art, e.g., silicones, polyolefins, polyurethanes, polyesters, acrylics, epoxies, rubber-resin, and polyamides.

Figure 3:
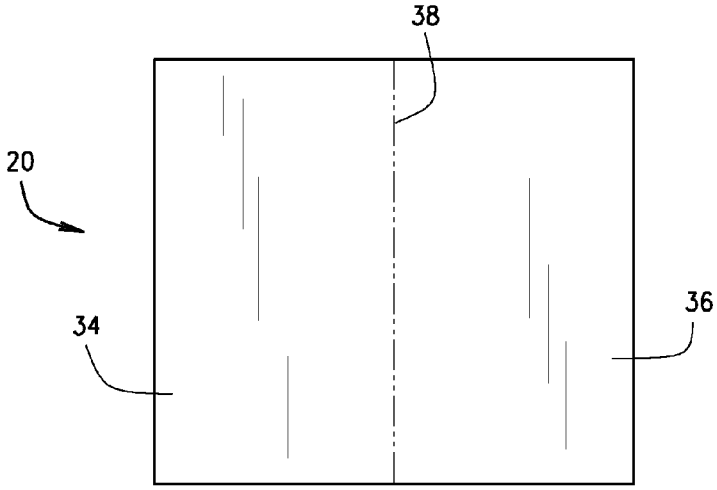
FIG. 3 illustrates an information destruction apparatus of the present disclosure, structured and operable for destroying, obliterating, altering or otherwise rendering unreadable confidential indicia printed on the label shown in FIGS. 1 and 2, configured as an envelope structure, in accordance with various embodiments of the present disclosure.
Figure 5:
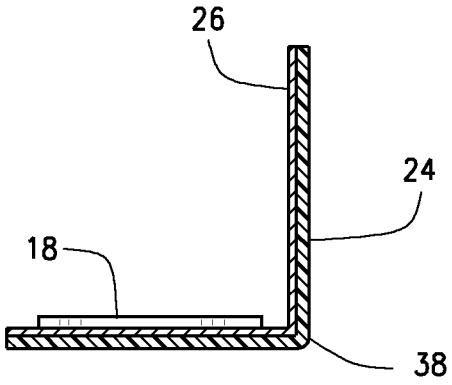
FIG. 5 illustrates an exaggerated edge view of the information destruction apparatus shown in FIG. 3 having a first and a second portion folded along the fold line at a right angle, in accordance with various embodiments of the present disclosure.
Figure 6:
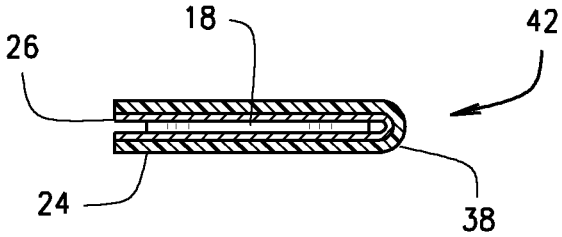
FIG. 6 illustrates an exaggerated edge view of the information destruction apparatus shown in FIG. 3 having the first and second portions folded into a Closed position and with the label shown in FIGS. 1 and 2 disposed therebetween, in accordance with various embodiments of the present disclosure.

As shown in FIG. 3, in various embodiments, the envelope 20 includes a first portion 34, a second portion 36, and a fold line or living hinge 38 connecting the first and second portions 34 and 36. The base layer inner surface 30 encompasses the inner surface of the first and second portions 34 and 36. The first portion 34 and the second portion 36 can be folded relative to one another between an open position, as shown in FIGS. 3 and 4, to a partially folded or intermediated position, as shown in FIG. 5, by folding the first and second portions 34 and 36 relative to one another along fold line 38. Further, the envelope 20 can be further pivoted to a folded or closed position, as shown in FIG. 6, via the living hinge 38, in which the first and second portions 34 and 36 are folded over each other.

As exemplarily illustrated in FIGS. 3-6, in various embodiments, the base layer 24 can have a rectangular shape. The base layer 24, however, can have a variety of shapes such as elliptical, oval, circular, triangular, square, or other appropriate configuration. In various rectangular implemtations, the sides of the rectangular base layer 24 can have a length ranging from about two inches to about fourteen inches. The dimensions, however, are exemplary and are not intended to limit the scope of the disclosure. Hence, the base layer 24 can be of any size and shape suitable to accommodate the needs of users or to accommodate the size and shape of the thermally responsive label 18 or container 12.

The microwave layer 26 comprises a metalized layer operatively connected to the inner surface 30 of the base layer 24. The microwave layer 26 operatively connects to the inner surface 30, inclusive of the first and second portions 34 and 36, via any suitable adhesive or connections means. For example, in various implementations, the microwave layer 26 can operatively connect to the inner surface 30 by a high temperature structural epoxy resin adhesive.

In various embodiments, the microwave layer 26 comprises a microwave susceptor. Microwave susceptors are materials which, when exposed to microwave energy, absorb the electromagnetic energy generated by the microwaves and convert that energy to heat. In particular, microwave susceptors are typically a metallic film or the like that is responsive to microwave energy to heat the film and a substance (e.g., label 18) disposed in a heat transfer relation to the susceptor to convert microwave energy into exothermic thermal energy to produce heat. Thus, microwave susceptors convert a portion of incident microwave energy into heat. By placing the microwave susceptor next to a product in a microwave oven, the surface of the product exposed to the microwave susceptor is surface-heated by the susceptor.

In particular, when the microwave susceptor is placed in a microwave oven and exposed to microwave energy, i.e., an electromagnetic energy field, current begins to flow in the microwave susceptor due to an electromagnetic field generated by the microwave oven. The microwave susceptor maintains its electrical conductivity throughout exposure to microwave energy. This electrical conductivity allows continued absorption of microwave energy by the microwave susceptor. As the current flows, the microwave susceptor begins to heat as a function of the current generated and the surface resistance of the microwave susceptor.

The adhesive connecting the microwave layer 26 to the base layer inner surface 30 is capable of preventing large impedance shifts of the microwave susceptor by strong bonding of the microwave susceptor.

In various embodiments, the microwave susceptor can comprise a metal or metal alloy film, such as aluminum, stainless steel, nickel/iron/molybdenum alloys or nickel/iron/copper alloys. For a metal or metal alloy as the microwave susceptor, the thickness can be from about 20 to 500 Angstroms, e.g., from about 50 to 70 Angstroms.

The microwave susceptor can be constructed by a variety of methods such as vacuum metallization of conductive particles dispersed onto a suitable binder. The microwave susceptor can be applied as the microwave layer 26 by vapor coating or alternatively by coating a solution of metal particles dispersed in a solvent over the inner surface 30 of the base layer 24.

In one example, the metal of the microwave susceptor can be vaporized as a mixture of ions and charged metallic droplets of small size and size distribution. The vaporized metal is manipulated with electric fields and focused on the inner surface 30 of the base layer 24. The process is continued until the desired thickness of the layer is obtained. Other processes known in the art can be used to deposit a metallic layer on the microwave layer 26, such as electroless, electrolytic deposition or vacuum metallization methods.

In various implementations, the adhesive connecting the microwave layer 26 to the base layer inner surface 30 is capable of preventing large impedance shifts of the microwave susceptor by strong bonding of the microwave susceptor.

In various embodiments, the microwave layer 26 can comprise a microwave shield. Microwave shields are devices that do not heat appreciably in response to microwave energy, but reflect virtually all incident microwaves. Metallic foils are generally employed as microwave shields. Microwave shielding materials include relatively thick substrates of electrically conductive metals such as aluminum foil that reflect microwave energy without appreciably generating thermal energy. The microwave shield can be adhesive laminated to the inner surface 30. The degree of shielding can be reduced by perforations or by dividing the foils. Alternatively, metal mesh, grids or perforations in the metal or metal foil, having apertures or openings greater than about 2 mm in diameter, will provide partial shielding.

As described above, the microwave layer 26 can be selected to be a susceptor or a shield. The thickness of the microwave layer 26 layer can determine whether the resulting layer is a susceptor or a shield. Typically, a metallic layer having a thickness greater than 1 micrometer will essentially reflect microwaves, without arcing or appreciable heating, and act as a microwave shield. A metallic layer having a thickness less than 1 micrometer can act as a susceptor.

Turning to FIGS. 1-8, to destroy, obliterate, alter or otherwise render unreadable confidential information printed on the thermally responsive label 18, the user removes the thermally responsive label from the bottle or vessel 12. The user then handles the envelope 20 by moving the first portion 34 and the second portion 36 to the open position or partially folded position, as shown in FIGS. 4 and 5, thereby exposing the microwave layer 26 to the user. The user then places the thermally responsive label 18 on the microwave layer 26, e.g., on the portion of the microwave layer connected to the first portion 34, and folds the second portion 36 through the intermediate position to the closed position, as shown in FIG. 6 such that opposing sides of the thermally responsive label 18 are in thermal conductivity or contact with, i.e., in a heat transfer relation with, the microwave layer 26 connected to the base layer first and second portions 36. In the closed/folded position the envelope 20 substantially encases the thermally responsive label 18. With the thermally responsive label 18 encased within the envelope 20, the user places the envelope 20 in a microwave oven 43 and activates the microwave oven 43. The microwave oven 43 can be a source of microwave energy, i.e., electromagnetic waves, to which the information destruction apparatus 20, in the various embodiments described herein, can be exposed. For example, in various embodiments the microwave oven 43 can be a commercial microwave oven found in most households.

Figure 7:
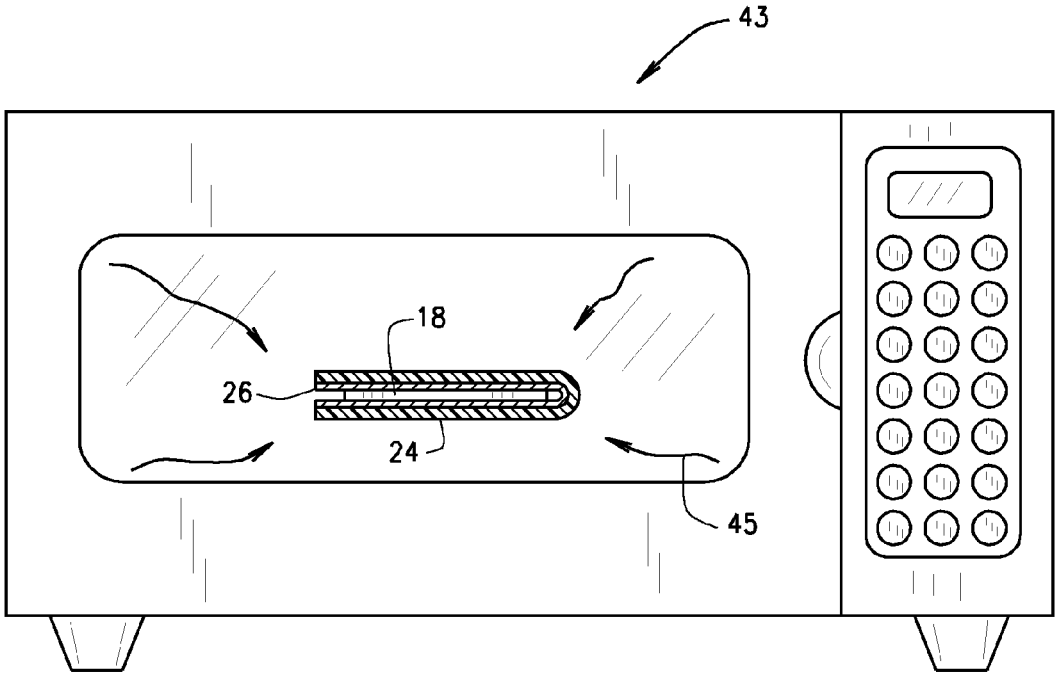
FIG. 7 illustrates a front view of the information destruction apparatus in the Closed position, with the label shown in FIGS. 1 and 2 disposed therebetween, disposed within a microwave oven, in accordance with various embodiments of the present disclosure.

The microwave oven 43 emits microwave energy 45 in the form of microwaves toward the envelope 20, wherein the microwave layer 26 receives the microwave energy 45 (FIG. 7). In response thereto, the microwave layer 26 converts the microwave energy 45 into heat. In particular, when microwave layer 26 is placed in the microwave oven 43 and exposed to microwave energy 45, current begins to flow in the metalized material of the microwave layer 26 due to an electromagnetic field generated by the microwave oven 43. The metalized material of the microwave layer 26 maintains its electrical conductivity throughout exposure to microwave energy 45. This allows continued absorption of microwave energy 45 by the microwave layer 26.

Figure 8:
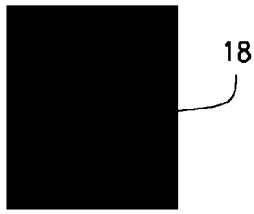
FIG. 8 illustrates a front view of the label of FIG. 7 with the confidential information shown as destroyed, obliterated, altered or otherwise rendered unreadable, in accordance with various embodiments of the present disclosure.

The microwave layer 26 absorbs energy at a desired frequency (e.g., between about 0.01 to about 300 GHz) very rapidly, in the range of fractions of a second or a few seconds. Importantly, the heat generated by the microwave layer 26 heats the thermally responsive label 18 to a temperature sufficient to activate dyes in the thermally responsive label 18 to destroy, obliterate, alter or otherwise render unreadable the confidential information on the label, as shown in FIG. 8. Higher or lower temperatures and longer or shorter times would be expected depending on the power rating of the microwave oven 43, thickness of the microwave layer 26 and the size of the thermally responsive label 18.

More specifically, as the current flows through the metalized layer of the microwave layer 26, the microwave layer 26 begins to heat as a function of the current generated and the surface resistance of the microwave layer 26. The thermally responsive label 18 is surface-heated by the produced heat of the microwave layer 26. In response thereto, the material of the thermally responsive label 18 reacts to the heat and destroys, obliterates, alters or otherwise renders unreadable the indicia on the thermally responsive label 18. That is, the energy from the microwave layer 26 heats the thermally responsive label 18 to a temperature that activates a thermal reaction of the materials of the thermally responsive label 18, that destroys, obliterates, alters or otherwise renders unreadable the indicia printed on the thermally responsive label 18. In various modes of operation, the energy from the microwave layer 26 can heat the thermally responsive label 18 to temperature sufficient to burn the thermally responsive label 18, thereby destroying, obliterating, altering or otherwise rendering unreadable the indicia printed on the thermally responsive label 18.

Referring now to FIGS. 9-12, in various embodiments, the information destruction apparatus 20 can be configured or structured to have a curvilinear or cylindrical tubular shape, referred to herein as casing 46. The curvilinear or cylindrical tubular shaped casing 46 comprises an outer base layer 48 and an inner microwave activated layer 50. The outer base layer 48 and the inner microwave layer 50 form a hollow cylindrical sleeve. The base layer 48 and the microwave layer 50, however, can form other configurations such as, for example, a tubular sleeve having a square, rectangular, triangular, or other polygonal or curvilinear cross section. In various implementations, the casing 46 can have a length from about one inch to about fourteen inches. The dimensions, however, are exemplary and are not intended to limit the scope of the disclosure. Thus, the casing 46 can be of any size suitable to accommodate characterizations of users, or of the size and shape of label 18 and/or bottles 12.

Figure 9:
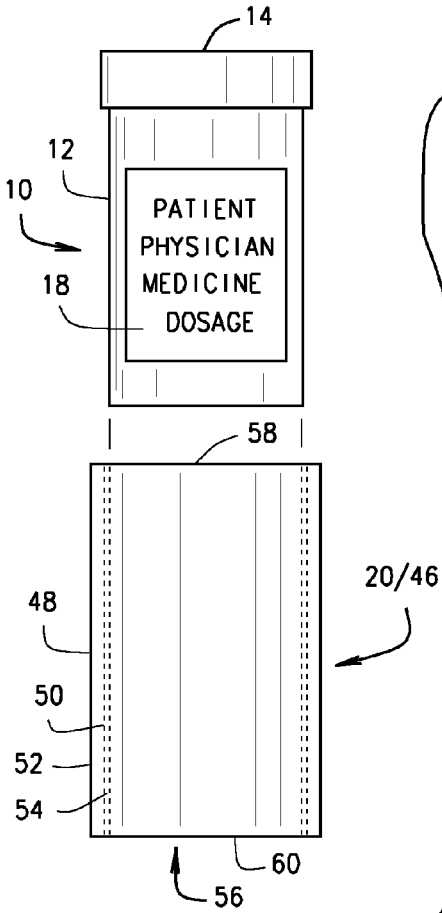
FIG. 9 illustrates a front view of the information destruction apparatus of the present disclosure configured as a cylindrical structure, in accordance with various embodiments of the present disclosure.
Figure 10:
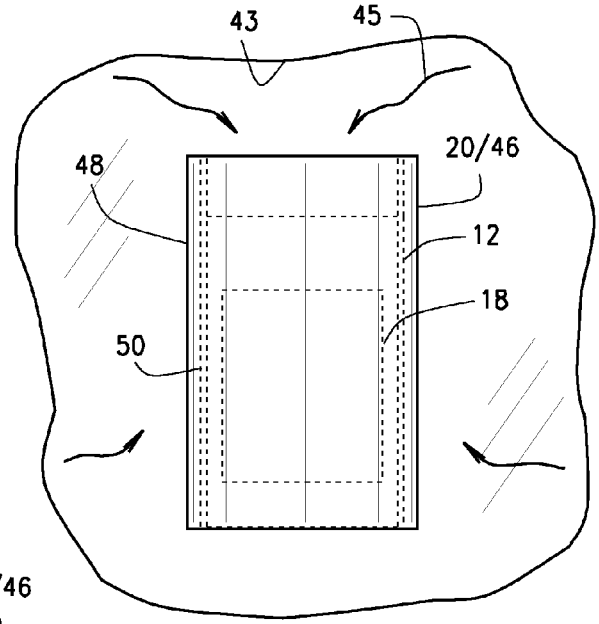
FIG. 10 is a view of the container disposed within the information destruction apparatus shown in FIG. 9 positioned within a microwave oven, in accordance with various embodiments of the present disclosure.
Figure 11:
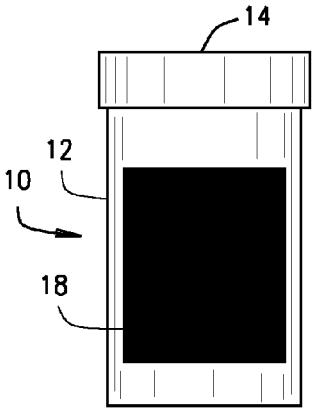
FIG. 11 illustrates a front view of the container and label of FIGS. 9 and 10 with the confidential information shown as destroyed, obliterated, altered or otherwise rendered unreadable, in accordance with various embodiments of the present disclosure.
Figure 12:
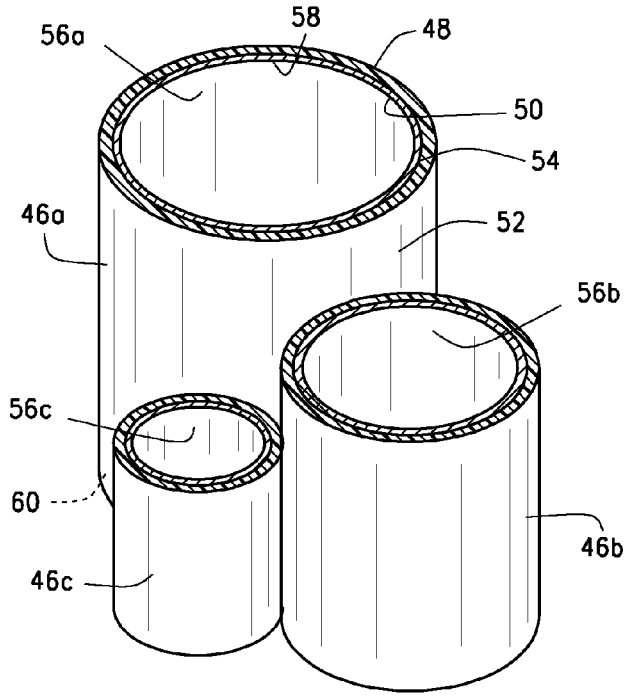
FIG. 12 illustrates a variety different sizes of the cylindrical information destruction apparatus shown in FIG. 9 for accommodating containers of different diameters or cross sections, in accordance with various embodiments of the present disclosure.

It should be noted that outer base layer 48 and inner microwave layer 50 are not drawn to scale in FIGS. 9, 10 and 12. It should be noted that the thicknesses of the layers 48 and 50 shown in the FIGS. 9-12 are not drawn to scale, but rather are exaggerated for clarity of illustration. The outer base layer 48 can comprise the base materials previously described with regard to base layer 28 of FIGS. 3-6. The inner microwave layer 50 can comprise the microwave susceptor material or the microwave shield material previously described with regard to microwave layer 26 of FIGS. 3-6.

As exemplarily illustrated in FIGS. 9 and 12, the casing 46 can be provided in a variety of different diameters and lengths where the base layer 48 includes an outer circular wall 52 and an inner circular wall 54. The inner microwave layer 50 operatively connects to the inner circular wall 54 and defines a bottle receptacle or passageway 56 in the casing 46. Passageway 56 is shown to be cylindrical having an opening 58 and another opening 60 at opposing ends of the microwave layer 50. The passageway 56 is shown to have a generally circular smooth cross-sectional configuration along the length of the passageway 56. To match the cross sectional shape and dimensions of bottle or vessel 12, the passageway 56 can have other cross sectional shapes and dimensions, such as, for example, tubular with a square, rectangular, triangular, pentagonal, hexagonal or octagonal cross section.

In various embodiments, the bottle receptacle or passageway 56 can have a diameter from about a half of an inch to about six inches and a length from about one inch to about fourteen inches. The dimensions, however, are exemplary and are not intended to limit the scope of the disclosure. The passageway 56 can be of any size and shape suitable to accommodate characterizations of users, or of the size and shape of label 18 and/or bottles 12.

Referring now to FIG. 12, the casing 46 is exemplarily illustrated in three different sizes (i.e., of different cross sections and lengths) identified by reference numerals 46*a*, 46*b* and 46*c*. The casings 46*a*, 46*b* and 46*c* provide a plurality of different sized passageways 56*a*, 56*b* and 56*c* formed by the respective microwave layer 50. These passageways 56*a*, 56*b* and 56*c* correlate to different sized bottles or vessels 12. The casings 46*a*, 46*b* and 46*c* can be connected to each other as a single portable piece via connectors such as, but not limited to, adhesives, hook and loop fasteners and welds. Alternatively, the casings 46*a*, 46*b* and 46*c* can be separate from each other providing individual, portable and different sized passageways 56*a*, 56*b* and 56*c*. In one example, separate casings 46*a*, 46*b* and 46*c* can nest within one another for convenient storage (not shown). Regardless of the connectivity, casings 46*a*, 46*b* and 46*c* allow the user the convenience of choosing the preferred sized passageway 56*a*, 56*b* and 56*c* for a particular size bottle or vessel 12.

With further reference to FIGS. 9-12, to destroy, obliterate, alter or otherwise render unreadable confidential information printed on the thermally responsive label 18, the user deposits the bottle or vessel 12 having the thermally responsive label 18 affixed thereto within the passageway 56 of the casing 46 such that the thermally responsive label 18 is in thermal conductivity with the casing 46, i.e., in heat transfer relationship with the casing 46. The user then places the casing 46, with the bottle/vessel 12 disposed therein, in the microwave oven 43 and activates the microwave oven 43 (shown in FIG. 10). In the various embodiments wherein the microwave layer 50 comprises the microwave susceptor, the casing 50 is sized such that when the bottle/vessel 12 is placed within the casing 50, the thermally responsive label 18 is in contact with or is otherwise in a heat transfer relation with the microwave layer 50 of the casing 46. Therefore, activation of the microwave oven 43 will cause the microwave layer 50 to heat the thermally responsive label 18 to a temperature sufficient to destroy, obliterate, alter or otherwise render unreadable the confidential information on the thermally responsive label 18 when the microwave layer 50 receives the emitted microwave energy 45 from the microwave oven 43, as described above with regard to FIGS. 1-8.

In other embodiments wherein the microwave layer 50 includes a microwave shield, the casing 50 is sized such that when the bottle/vessel 12 is placed within the casing 50, the thermally responsive label 18 is spaced apart from microwave layer 50. In other words, the diameter of the passageway 56 is larger than the outside diameter of the bottle/vessel 12 such that when the user deposits the bottle/vessel 12 within the passageway 56 of the casing 46, the thermally responsive label 18 does not contact the microwave layer 50. Upon activation of the microwave oven 43, the microwave shield reflects the incident microwaves 45, generated by the microwave oven 43, toward the thermally responsive label 18. In response to the reflected microwave energy 45, the thermally responsive materials of the thermally responsive label 18 react and destroy, obliterate, alter or otherwise render unreadable the indicia printed on the thermally responsive label 18. Particularly, the reflected microwave energy 45 heats the thermally responsive label 18 to a temperature that activates a thermal reaction of the materials that destroys, obliterates, alters or otherwise renders unreadable the indicia printed on the thermally responsive label 18. In another mode of operation, the energy from the microwave layer 50 heats the thermally responsive label 18 to a temperature so that the thermally responsive label 18 is burned to destroy, obliterate, alter or otherwise render unreadable the indicia printed on the thermally responsive label 18.

Referring now to FIGS. 13-18, in various embodiments, the information destruction apparatus 20 can be configured or structured to form a flexible configuration such as a coil or spiral, referred to herein as coiled casing 64. In such embodiments, the ends of casing 64 are not joined, but are free to expand or contract so as to form a central opening of different sizes (diameters) so as to accommodate bottles/vessels 12 of different diameters. The casing 64 comprises a base layer 66 and a microwave activated layer 68. In various implementations, the casing 64 can have a length from about one inch to about fourteen inches. The base layer 66 and the microwave layer 68 are configured to form the flexible coil or spiral structure that defines the coiled casing 64. It should be noted that the thicknesses of the layers 66 and 68 shown in the FIGS. 13-16 are not drawn to scale, but rather are exaggerated for clarity of illustration. The outer base layer 66 can comprise the base materials previously described with regard to base layer 28 of FIGS. 3-6. The inner microwave layer 68 can comprise the microwave susceptor material or the microwave shield material previously described with regard to microwave layer 26 of FIGS. 3-6.

Figure 14:
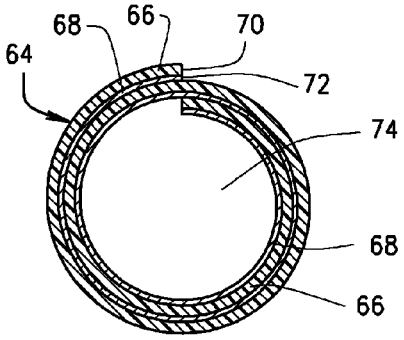
FIG. 14 illustrates an end view of the information destruction apparatus of FIG. 13, in accordance with various embodiments of the present disclosure.
Figure 15:
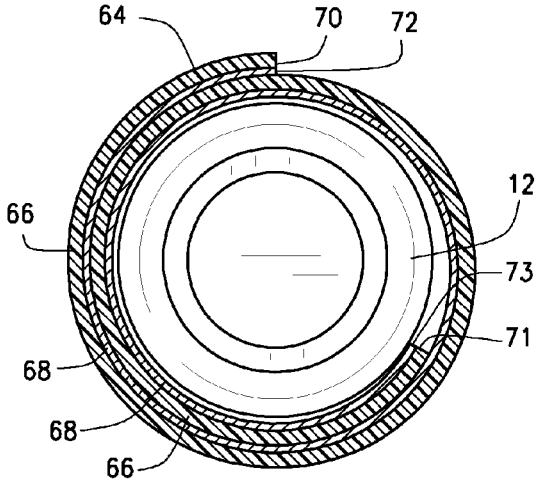
FIG. 15 is an end view of the information destruction apparatus of FIGS. 13 and 14 configured to retain a small container disposed therein, in accordance with various embodiments of the present disclosure.
Figure 16:
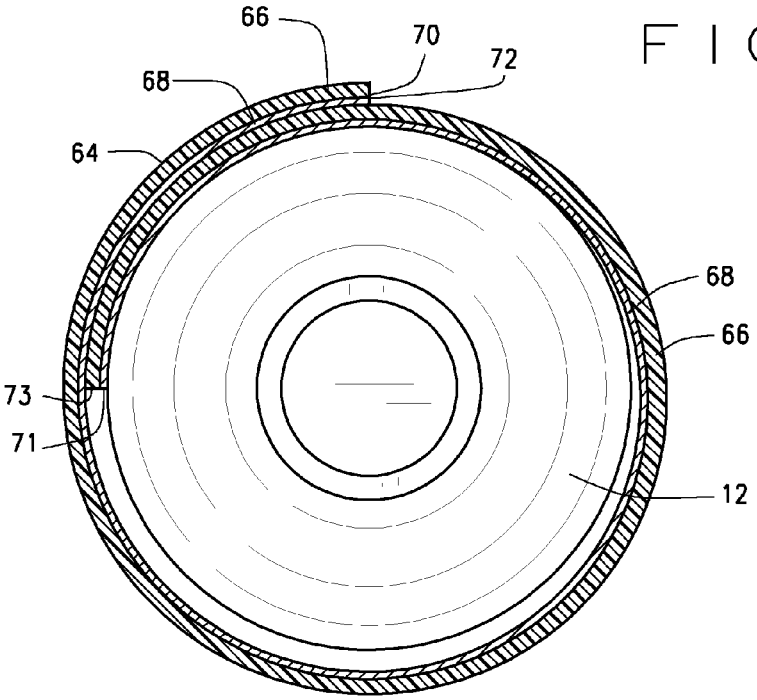
FIG. 16 is an end view of the information destruction apparatus of FIGS. 13 and 14 configured to retain a large container disposed therein, in accordance with various embodiments of the present disclosure.

FIGS. 14, 15 and 16 exemplarily illustrate a casing 64 of the same length. The casing 64 is shown in a contracted position. In FIG. 15, the casing 64 is shown in a contracted condition so as to enclose a smaller bottle/vessel 12. In FIG. 15, the casing 64 is shown in a slightly expanded condition so as to enclose a larger bottle/vessel 12 having a greater outside diameter than that of FIG. 14. And, in FIG. 16, the casing 64 is shown in a near fully expanded condition so as to enclose a larger bottle/vessel 12 having a greater outside diameter than that of FIG. 15. Accordingly, the single casing 64 can be used with a wide size range of bottles/vessels 12 having various outside diameters.

In such embodiments, the base layer 66 and microwave layer 68 comprise spring-like, or flexible materials. The base layer 66 has a first end 70 and second end 71, and the microwave layer 68 has a first end 72 and a second end 73. Microwave layer ends 72 and 73 are exemplarily shown to be coextensive, respectively, with the base layer ends 70 and 71. In various implementations, the base layer 66 and microwave layer 68 can have lengths from about two inches to about 14 inches. As the casing 64 is expanded and contracted to accommodate different size bottles/vessels 12, the inside of the microwave layer 68 slides along the outside of base layer 66.

Figure 13:
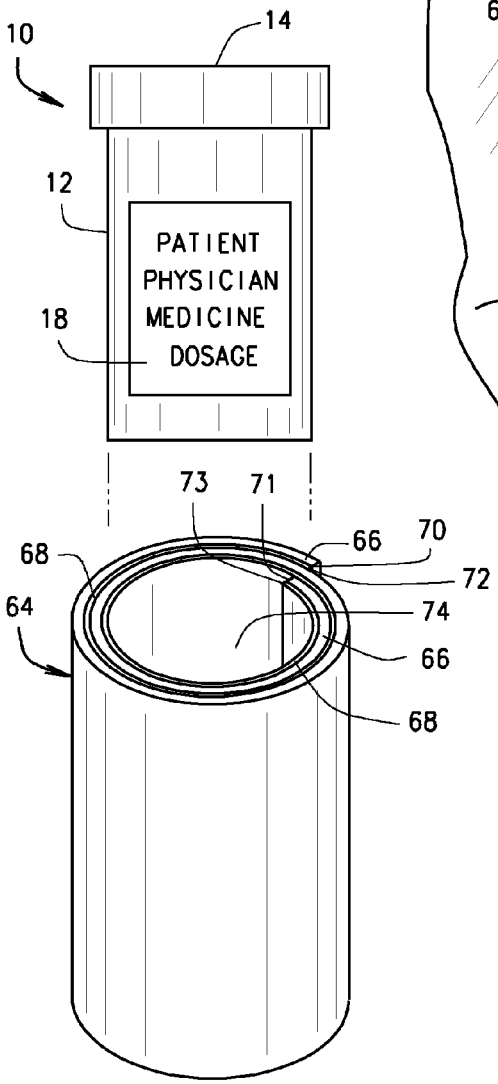
FIG. 13 illustrates a front view of the information destruction apparatus of the present disclosure configured as an expandable and contractible coiled cylindrical structure, in accordance with various embodiments of the present disclosure.
Figure 17:
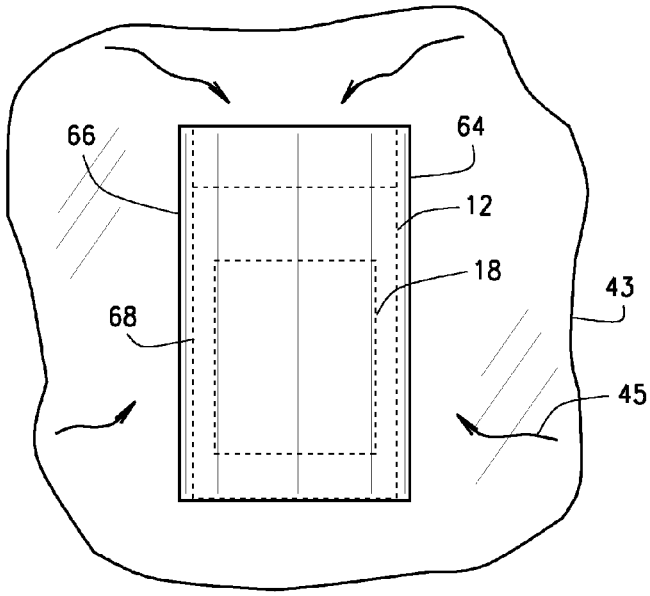
FIG. 17 is a view of the container disposed within the information destruction apparatus shown in FIGS. 14-16 positioned within a microwave oven, in accordance with various embodiments of the present disclosure.
Figure 18:
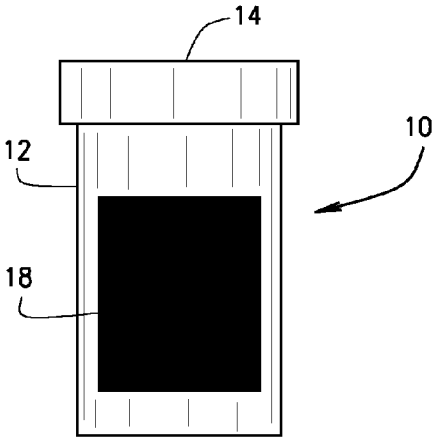
FIG. 18 illustrates a front view of the container and label of FIGS. 13 and 17 with the confidential information shown as destroyed, obliterated, altered or otherwise rendered unreadable, in accordance with various embodiments of the present disclosure.

The materials of the base layer 66 and microwave layer 68 are such that once they are moved to a certain position, such as what are shown in FIGS. 14-16, the prehensile forces of layers 66 and 68 will cause the inside surface of the microwave layer 68 to grip the bottle/vessel 12 and label 18 disposed thereon. As illustrated in FIGS. 13 and 14, the microwave layer 68 forms a bottle receptacle or passageway 74 through the casing 64 that can be expanded and contracted to fit a plurality of sizes of bottles/vessels 12. In various implementations, the diameter of the passageway 74 can expand and contract between about one-half of an inch to about 14 inches.

The resilient flexible materials of the base layer 66 and the microwave layer 68, cause layers 66 and 68 to apply a prehensile gripping force against the bottle/vessel 12 to hold the bottle/vessel 12 within the passageway 74. Since the casing 64 can form the coil configuration, the casing 64 provides the user with the convenience of repeatedly sizing the passageway 74 for any particularly sized bottles/vessels 12. Accordingly, the user has the convenience of one casing 64 expanding or contracting to accept different sized bottles/vessels.

Referring now to FIGS. 13-18, to destroy, obliterate, alter or otherwise render unreadable confidential information printed on the thermally responsive label 18, the user deposits the bottle/vessel 12 and thermally responsive label 18 affixed thereto within the passageway 74 of the coiled casing 64 such that the thermally responsive label 18 is in thermal conductivity with the coiled casing 64, i.e., in a heat transfer relationship with the coiled casing 64. The prehensile force brought about by the resilient flexible materials of the base layer 66 and the microwave layer 68 flex or tension to coil around the bottle/vessel 12 so that the microwave layer 68 contacts the thermally responsive label 18.

The user the places the casing 64, having the bottle/vessel 12 with the thermally responsive label 18 disposed within the passageway 74, in the microwave oven 43 and activates the microwave oven 43 as previously discussed. As described above, in various implementations, the microwave layer 68 can comprise a microwave susceptor, whereby when the thermally responsive label 18 is in contact with the microwave susceptor layer 68, the microwave layer 68 heats the thermally responsive label 18 when the microwave layer 68 receives the emitted microwave energy 45 from the microwave oven 43. In response to the surface heat, the materials of the thermally responsive label 18 react and destroy, obliterate, alter or otherwise render unreadable the indicia printed on the thermally responsive label 18. Particularly, the energy from the microwave layer 68 heats label 18 to a temperature that activates a thermal reaction of the materials label 18 that destroys, obliterates, alters or otherwise renders unreadable the indicia printed label 18. As also described above, in another embodiments, the heat generated by the microwave layer 68 reaches a warm temperature so that the thermally responsive label 18 is burned to destroy, obliterate, alter or otherwise render unreadable the indicia printed on the thermally responsive label 18.

Upon destroying, obliterating, altering or otherwise rendering unreadable the indicia, the user removes the bottle/vessel 12 (FIG. 18) from the passageway 74. Upon removal, the resilient flexible materials of the base layer 66 and the microwave layer 68 can contract to the predetermined smaller passageway.

Referring now to FIGS. 19-24, in various embodiments, the information destruction apparatus 20 can be configured or structured to form an attachable label strip, referred to herein as label strip 78. The label strip is structured and operable to be adhered to the bottle/vessel 12 and/or the thermally responsive label 18 such that the thermally responsive label 18 is in thermal conductivity with the label strip 78, i.e., in a heat transfer relationship with the label strip 78. In various implementations, the label strip 78 can comprise a base layer 80 having a microwave activated layer 82 affixed thereto, or integrated therewith. The label strip 78 can have a length from about one inch to about fourteen inches and can have a height from about one inch to about six inches. Particularly, the label strip 78 can be fabricated in various sizes whereby a particular sized label strip 78 can be selected so that the adhesive layer 80 and the microwave layer 82 cover the thermally responsive label 18 affixed to a particular bottle/vessel 12 when the label strip 78 is adhered to the respective bottle/vessel 12, as described below.

In various embodiments, the label strip 78 can be fabricated of the base layer 80, comprised of a paper-like material, with the microwave activated layer 82 affixed to the base layer 80 via an adhesive material. The adhesive material can be any adhesive suitable to securely affix the microwave layer 82 to the base layer 82. For example, in various implementations, the adhesive can comprise a suitable solvent-coatable, hot-melt-coatable, radiation-curable and water-based emulsion type adhesive that is known in the art, e.g., silicones, polyolefins, polyurethanes, polyesters, acrylics, epoxies, rubber-resin, and polyamides. The microwave layer 82 can comprise the microwave susceptor material or the microwave shield material previously described with regard to microwave layer 26 of FIGS. 3-6.

In various other embodiments, the label strip 78 can comprise a microwave activated material, i.e., the microwave activated layer 82, integrally formed with, e.g., integrally dispose on or embedded within, the base layer 80. For example, during manufacturing of the base layer 80, the microwave activated material 82 can be integrally disposed on, blended with, impregnated within, or embedded within the material of the base layer 80 such that the microwave activated material is integrally formed or bonded with the base layer 80.

Figure 19:
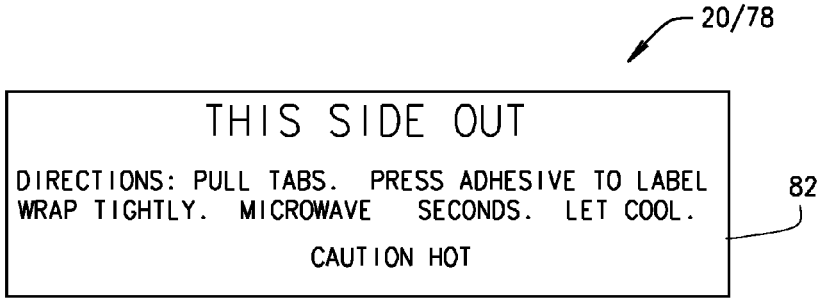
FIG. 19 illustrates a front view of the information destruction apparatus of the present disclosure configured as an adhesive label strip, in accordance with various embodiments of the present disclosure.

As exemplarily illustrated in FIG. 19, in various embodiments, directions for use of the label strip 78 can be imprinted on one of the faces of the label strip 78.

Figure 20:
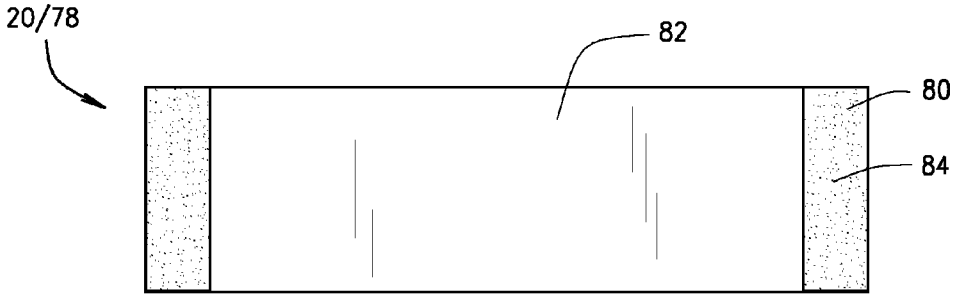
FIG. 20 illustrates a rear view of the information destruction apparatus of FIG. 19, in accordance with various embodiments of the present disclosure.
Figure 21:
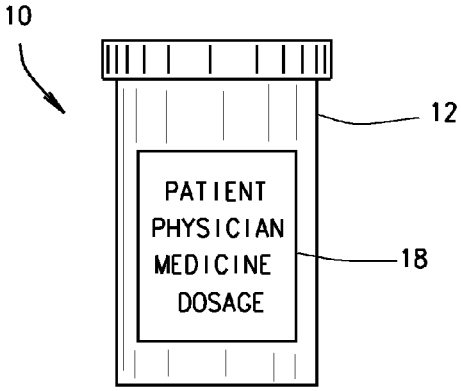
FIG. 21 illustrates a front view of a prescription container having a thermally responsive label affixed thereto, the label having confidential information or indicia printed thereon, in accordance with various embodiments of the present disclosure.
Figure 22:
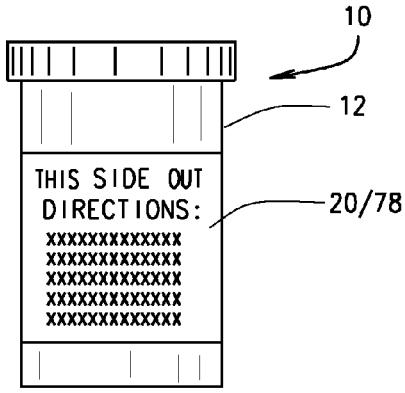
FIG. 22 illustrates the label adhesive label strip of FIG. 19 attached to and covering the container label of FIG. 21, in accordance with various embodiments of the present disclosure.
Figure 23:
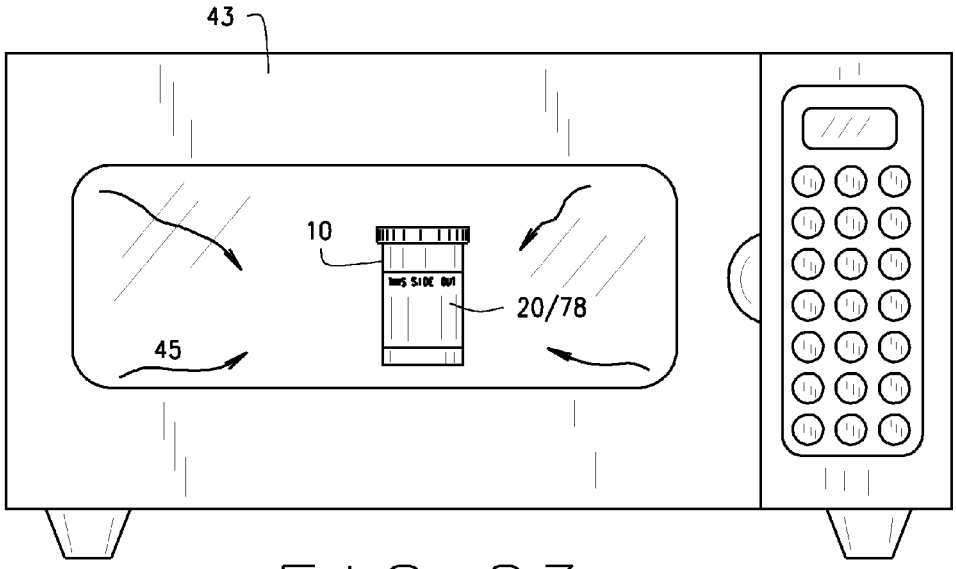
FIG. 23 is a view of the container having the adhesive label strip of FIG. 19 disposed over the container label and positioned within a microwave oven, in accordance with various embodiments of the present disclosure.

Referring now to FIG. 20, in various embodiments, the label strip 78 includes at least one label fastener 84 structured and operable to affix the label strip 78 to a respective bottle/ vessel 12 such that the thermally activated label 18 is in thermal conductivity with the label strip 78, i.e., in a heat transfer relationship with the label strip 78. In various implementations, the fastener(s) 84 can comprise an adhesive strip disposed at opposing ends of the label strip 78, as exemplarily illustrated in FIG. 20. In such embodiments, removable tabs can be disposed over the adhesive strips. However, any fastener that attaches the label strip 78 to the bottle/vessel 12 and/or the thermally responsive label 18 of the container 10 is intended to be within the scope of the disclosure.

Referring again to FIGS. 19-24, to destroy, obliterate, alter or otherwise render unreadable confidential information printed on the thermally responsive label 18, the user selects the appropriate sized label strip 78 and wraps the label strip 78 around the respective bottle/vessel 12 such that the label strip 78 covers the thermally responsive 18, or at least covers the confidential indicia on the thermally responsive label 18, and such that the thermally responsive label 18 is in thermal conductivity with the label strip 78, i.e., in a heat transfer relationship with the label strip 78. The user utilizes the fastener(s) 84, e.g., adhesive strips, to secure the label strip 78 to the bottle/vessel 12 such that the label strip 78 is in substantial contact with the thermally responsive label 18. As described above, the label strip 78 can be sized and shaped to wholly or partially cover the thermally responsive label 18.

Subsequently, the user places the bottle/vessel 12 having the label strip 78 attached thereto in the microwave oven 43 and activates the microwave oven 43, as described above with reference to FIGS. 1-8. In various implementations, the microwave layer/integrally disposed material 82 comprises a microwave susceptor material. Accordingly, when the microwave oven 43 is activated, the microwave layer/integrally disposed material 82, comprising the susceptor material, heats up in response to exposure to the electromagnetic microwaves generated by the microwave oven 43. This heat in turn heats the thermally responsive label 18. Subsequently, in response to the heat, the thermally responsive materials of the thermally responsive label 18 react and destroy, obliterate, alter or otherwise render unreadable indicia printed on the thermally responsive label 18. In other embodiments, the heat generated by the microwave layer 82 reaches a temperature sufficient to burn the thermally responsive label 18 such the indicia printed on the thermally responsive label 18 is destroyed, obliterated, altered or otherwise rendered unreadable.

Figure 25:
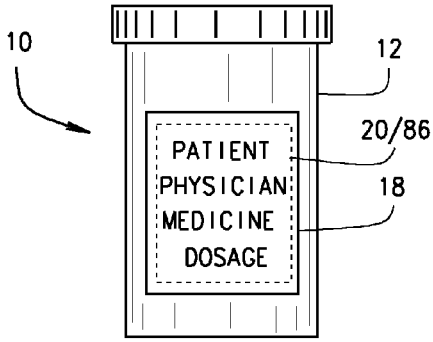
FIG. 25 illustrates a front view of the information destruction apparatus of the present disclosure configured as a label foundation patch, in accordance with various embodiments of the present disclosure.
Figure 26:
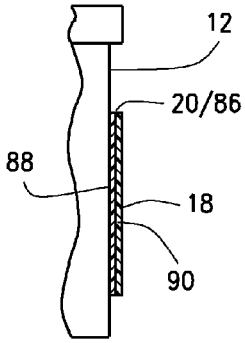
FIG. 26 illustrates an exaggerated side view of the label foundation patch, in accordance with various embodiments of the present disclosure.

Referring now to FIGS. 25-26, in various embodiments, the information destruction apparatus 20 can be configured or structured to form an adhesive label foundation patch, referred to herein as label patch 86. Generally, the label patch 86 is affixed to the bottle/vessel 12 and provides a base or foundation to which the thermally responsive label 18 is affixed. In such embodiments, the label patch 86 comprises an adhesive layer 88 and a microwave activated layer 90. The label patch 86 can have a length from about one inch to about fourteen inches and can have a height from about one inch to about six inches. The adhesive layer 88 is configured to be affixable to the bottle/vessel 12 such that the thermally responsive label 18 can be overlaid and affixed to the microwave layer 90. The adhesive layer 88 can affixable to the bottle/vessel 12 using any suitable adhesive. For example, in various implementations, the adhesive can comprise a suitable solvent-coatable, hot-melt-coatable, radiation-curable and water-based emulsion type adhesive that is known in the art, e.g., silicones, polyolefins, polyurethanes, polyesters, acrylics, epoxies, rubber-resin, and polyamides.

The microwave layer 90 can comprise the microwave susceptor material or the microwave shield material previously described with regard to microwave layer 26 of FIGS. 3-6.

As illustrated in FIGS. 25 and 26, the label patch 86 is structure to be affixed to the bottle/vessel 12 whereafter the thermally responsive label 18 can be affixed to the label patch 86 such that the thermally responsive label 18 is in thermal conductivity with the label patch 86, i.e., in a heat transfer relationship with the label patch 86. Accordingly, the label patch 86 is disposed between the thermally responsive label 18 and the bottle/vessel 12. It should be noted that the dimensions of the label 19 and the label patch 86 shown in the FIGS. 25-26 are not drawn to scale, but rather are exaggerated for clarity of illustration.

In various implementations, the adhesive layer 88 contains an adhesive, e.g., an adhesive strip, adhesive backing or adhesive coating, suitable for affixing the label patch 86, including the microwave layer 90, to the bottle/vessel 12. The adhesive can comprise adhesive suitable for affixing the label patch 86 to the bottle/vessel 12. For example, in various implementations, the adhesive layer can comprise a suitable solvent-coatable, hot-melt-coatable, radiation-curable and water-based emulsion type adhesive that is known in the art, e.g., silicones, polyolefins, polyurethanes, polyesters, acrylics, epoxies, rubber-resin, and polyamides.

Figure 24:
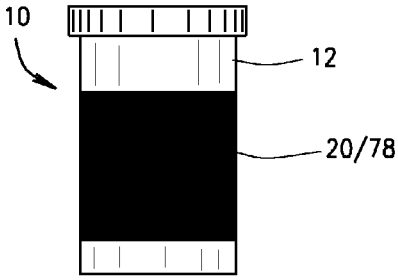
FIG. 24 illustrates a front view of the container and label of FIGS. 22 and 23 with the confidential information shown as destroyed, obliterated, altered or otherwise rendered unreadable, in accordance with various embodiments of the present disclosure.

In accordance with the embodiments illustrated in FIGS. 24-26, the label patch 86 is affixed to the bottle/vessel 12 prior to the thermally responsive label 18. That is, the pharmacist, or other person preparing the bottle/vessel 12 for use, affixes the label patch 86 to the bottle/vessel 12 utilizing the adhesive disposed on the adhesive layer 88. Subsequently, the pharmacist, or other person preparing the bottle/vessel 12 for use, affixes the thermally responsive label 18 to the label patch 86 such that any confidential indicia on the thermally responsive label 18 overlays the label patch 86. Then when a user wishes to destroy, obliterate, alter or otherwise render unreadable confidential information printed on the thermally responsive label 18, the user places the bottle/vessel 12 having the label patch 86 and label 18 attached thereto in the microwave oven 43 and activates the microwave oven 43.

In various implementations, the microwave layer 90 comprises a microwave susceptor material. Accordingly, when the microwave oven 43 is activated, the microwave layer 90, comprising the susceptor material, heats up in response to exposure to the electromagnetic microwaves generated by the microwave oven 43. This heat in turn heats the thermally responsive label 18. Subsequently, in response to the heat, the thermally responsive materials of the thermally responsive label 18 react and destroy, obliterate, alter or otherwise render unreadable indicia printed on the thermally responsive label 18. In other embodiments, the heat generated by the microwave layer 90 reaches a temperature sufficient to burn the thermally responsive label 18 such the indicia printed on the thermally responsive label 18 is destroyed, obliterated, altered or otherwise rendered unreadable.

Figure 27:
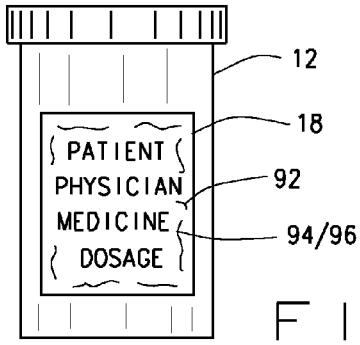
FIG. 27 illustrates a front view of the information destruction apparatus of the present disclosure configured as an information label having a microwave activated layer embedded within the label, in accordance with various embodiments of the present disclosure.

Referring now to FIG. 27, in various embodiments the information destruction apparatus 20 can be configured or structured as the thermally responsive label 18, referred to herein as information destruction label 92. In such embodiments, the information destruction label 92 comprises a microwave activated material 96, e.g., a microwave activated layer, integrally formed with, e.g., disposed on or embedded within, a thermally responsive label structure 94. For example, during manufacturing of the information destruction label 92, the microwave activated material 96 is disposed on or embedded within the thermally responsive label structure 94 such that the microwave activated material is integrally formed or bonded with the thermally responsive label structure 94.

The information destruction label 92, of the present embodiments, can affixable to the bottle/vessel 12 using any suitable adhesive that is disposed on the thermally responsive label structure 94. For example, in various implementations, the adhesive can comprise a suitable solvent-coatable, hot-melt-coatable, radiation-curable and water-based emulsion type adhesive that is known in the art, e.g., silicones, polyolefins, polyurethanes, polyesters, acrylics, epoxies, rubber-resin, and polyamides.

Specifically, in the embodiments illustrated in FIG. 27, the thermally responsive label 18 comprises the information destruction label 92. Accordingly, in use the pharmacist, or other person preparing the bottle/vessel 12 for use, disposes the confidential information/indicia on the information destruction label 92, i.e., the thermally responsive label structure having the microwave activate material integrally formed therewith. The pharmacist, or other person preparing the bottle/vessel 12 for use then affixes the information destruction label 92 to the bottle/vessel 12 utilizing the adhesive disposed on the information destruction label 92.

Subsequently, when a user wishes to destroy, obliterate, alter or otherwise render unreadable confidential information printed on the information destruction label 92, the user places the bottle/vessel 12 having the information destruction label 92 attached thereto in the microwave oven 43 and activates the microwave oven 43. In response to exposure to the electromagnetic microwaves generated by the microwave oven 43, the microwave activated material 96, integrally formed with, e.g., disposed on or embedded within, the thermally responsive label structure 94, heats up thermally responsive label structure causing the destruction, obliteration, alteration or otherwise rendering unreadable of the indicia printed on the information destruction label 92.

As various changes could be made in the above constructions without departing from the scope of the disclosure, it is intended that all matter contained in the above description or shown in the accompanying drawings shall be interpreted as illustrative and not in a limiting sense.

What is claimed is:

1. A method for rendering unreadable indicia printed on a label, the method comprising:

attaching an information destruction strip to at least one of a label support structure having disposed thereon a thermally responsive label having indicia printed thereon and a thermally responsive label having indicia printed thereon such that the information destruction strip is in a thermally conductive relationship with the thermally responsive label, the information destruction strip sized to cover at least the indicia printed on the thermally responsive label, the information destruction strip comprising a microwave activated material operable to generate heat when exposed to microwave energy;

placing the label support structure, having the information destruction strip attached to the at least one of the label support having disposed thereon a thermally responsive label structure and thermally responsive label such that the information destruction strip covers at least the printed indicia and is in a thermally conductive relationship with the thermally responsive label, in a microwave oven;

activating the microwave oven such that the microwave oven emits microwave energy, whereby the microwave activated material absorbs the microwave energy and generates heat of sufficient intensity to heat the thermally responsive label to a temperature sufficient to cause the thermally responsive label to react and render the indicia unreadable.

2. The method of claim 1, wherein attaching the information destruction strip comprises attaching the information destruction strip to at least one of a label support structure having disposed thereon a thermally responsive label and the thermally responsive label, wherein the information destruction strip comprises a base layer and a microwave activated layer affixed to the base layer, the microwave layer comprising the microwave activated material.

3. The method of claim 1, wherein attaching the information destruction strip comprises attaching the information destruction strip to at least one of a label support structure having disposed thereon a thermally responsive label and the thermally responsive label, wherein the information destruction strip comprises a base layer having the microwave activated material integrally formed with the base layer.

4. The method of claim 1, wherein attaching the information destruction strip comprises adhering the information destruction strip to the at least one of the label support structure having disposed thereon a thermally responsive label and the thermally responsive label using a pair of adhesive strips disposed at opposing end of the information destruction strip.

5. The method of claim 1, wherein attaching the information destruction strip to the at least one of the label support structure having disposed thereon a thermally responsive label and the thermally responsive label comprises attaching the information destruction strip to at least one of a medicine retention vessel and a thermally responsive prescription information and instruction label disposed on the medicine retention vessel.

* * * * *